United States Patent [19]

Sanford

[11] 4,220,956

[45] Sep. 2, 1980

[54] COLLINEAR SERIES-FED RADIO FREQUENCY ANTENNA ARRAY

[75] Inventor: Gary G. Sanford, Boulder, Colo.

[73] Assignee: Ball Corporation, Muncie, Ind.

[21] Appl. No.: 957,681

[22] Filed: Nov. 6, 1978

[51] Int. Cl.[3] ..... H01Q 1/28; H01Q 11/02

[52] U.S. Cl. ..... 343/706; 343/731; 343/806; 343/880; 343/827

[58] Field of Search ..... 343/705, 708, 792.5, 343/795, 812, 814, 908, 827, 806, 880, 706

[56] References Cited

U.S. PATENT DOCUMENTS

| | | | |
|---|---|---|---|
| 2,981,951 | 4/1961 | Wickersham | 343/792.5 |
| 2,990,547 | 6/1961 | McDougal | 343/792.5 |
| 3,500,424 | 3/1970 | Barbano et al. | 343/792.5 |
| 3,530,479 | 9/1970 | Waldron | 343/767 |
| 3,564,555 | 2/1971 | Rosenberry | 343/811 |
| 3,732,572 | 5/1973 | Kuo | 343/792.5 |

*Primary Examiner*—Eli Lieberman
*Attorney, Agent, or Firm*—J. David Haynes

[57] ABSTRACT

A collinear series-fed antenna array formed from two spaced-apart electrical conductors extending parallel to one another in a longitudinal direction and having regularly spaced complementary changes in transverse dimensions along the longitudinal direction. These two shaped conductors are connected at one end to an RF transmitter or receiver and are substantially isolated from electromagnetic interaction with other unconnected electrical conductors in the immediate vicinity. The array is preferably fabricated by etching a copper laminate adhered to one side of a dielectric sheet which serves solely to support the shaped conductors etched thereon. There is no ground plane associated with these conductors and the dielectric merely serves to support the antenna elements. The whole assembly can therefore be made very thin and flexible and formed into a compact unit for storage when not in use.

27 Claims, 4 Drawing Figures

COLLINEAR SERIES-FED RADIO FREQUENCY ANTENNA ARRAY

This invention is generally directed to radio frequency antenna arrays and, in particular, to a collinear, series-fed array of radio frequency transmitting or receiving elements.

Collinear arrays of dipole radiators are well known in the art. They are typically used for communications applications where it is desired to transmit or receive equally well in all azimuthal directions but only toward the horizon in elevation. Furthermore, a series-fed collinear array of microstrip radiator elements is disclosed and claimed in my copending application, Ser. No. 683,203, filed May 4, 1976. However, there are communications applications where both technical and economic considerations make it difficult to employ either standard collinear arrays of dipole radiators or the series-fed collinear microstrip array. One example of such applications is an antenna array designed for deployment from an object suspended high above the earth and intended for communication with the earth. Such an array is preferably capable of deformation for compact storage prior to deployment. In addition, some applications of this type (i.e., deployment from a balloon) involve but brief single usages of the whole structure before it is discarded, thereby requiring a minimum cost for manufacture and usage.

If a series-fed microstrip array is used, a ground plane must be located at least about 0.01 wavelength behind the radiator patches. If such separation is significantly reduced beyond 0.01 wavelength, the antenna's performance, especially efficiency, is significantly degraded. However, for most frequencies, 0.01 wavelength implies a fairly thick structure comprising a dielectric with conductive layers laminated on both sides (one side being etched to form the microstrip radiator patches). Such a thick structure is not conveniently formed (i.e., rolled) into a compact package for storage purposes. A conventional collinear array of dipole radiators is, of course, even less adapted to such applications.

Now, however, it has been discovered that a collinear, series-fed array of radiators may be fabricated by simply etching a copper laminate adhered to one side of a very thin dielectric sheet. Both the copper laminate and the dielectric sheet may be made very thin and flexible since the only purpose of the dielectric is to physically support the shaped conductors etched thereon. Such a structure can easily be manufactured with a total thickness of less than 0.005 inch and can be manufactured relatively inexpensively. In other words, the antenna of this invention may be very simply manufactured as a thin, flexible (rollable), lightweight array having a directional radiation pattern in everyplane that includes the length of the array and an omnidirectional pattern in planes disposed orthogonal to the length of the array.

The array may be connected at one end to a mounting bracket and at the other end to a weight for automatically extending and/or maintaining the array in an elongated operating position after deployment from a compact storage location. In the presently preferred exemplary embodiment, the array is formed by two spaced apart shaped electrical conductors which extend substantially parallel to one another in a longitudinal direction and which have regularly spaced complementary changes in their transverse dimensions along the longitudinal direction. These shaped conductors are substantially isolated from electromagnetic interaction with other unconnected electrical conductors in the immediate vicinity. That is, there is no underlying ground plane or the like associated directly with the shaped conductors as might be expected, for example, in the case of the traditional microstrip radiator structures. The result is a substantially omnidirectional radiation pattern in planes transverse to the longitudinal direction of the array elements. The changes in transverse dimensions may comprise a series of projections directed outwardly away from the other shaped conductor or a series of projections which are directed inwardly towards the other shaped conductor.

These as well as other advantages and objects of this invention will be more completely understood by reading the following detailed description of the presently preferred exemplary embodiments in conjunction with the accompanying drawings, of which:

Some radiation can be obtained from a simple microstrip transmission line by merely providing regularly spaced variations in the dimensions of one of the conductors forming the transmission line. In effect, the impedance of the transmission line is varied at regular intervals along the line related to the wavelength of energy propagating therealong. Since such a line is unshielded, these variations in impedance will cause radiation to occur in a relatively uncontrolled manner.

Figure 1:
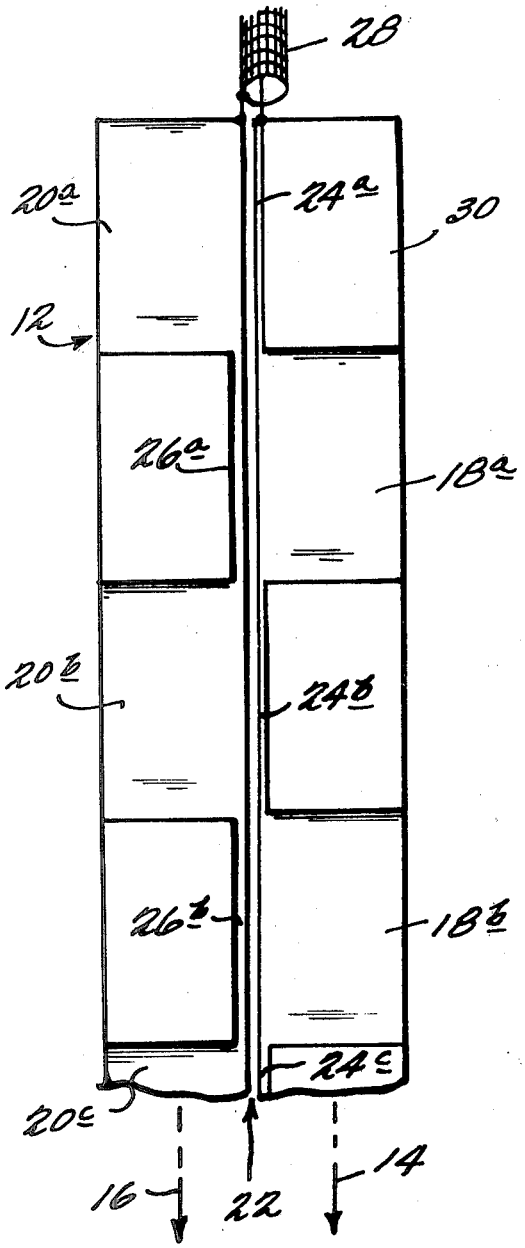
FIG. 1 is a partial cutaway plan view of the presently preferred exemplary embodiment of this invention.

However, it has been discovered that a more controlled radiation pattern may be achieved by also varying the dimensions of the other half of the microstrip line in a complementary fashion as shown in FIG. 1. The array shown in FIG. 1 operates much like a balanced antenna but does not require a balun.

As shown in FIG. 1, the antenna array comprises two spaced-apart shaped electrical conductors 10 and 12. These conductors extend parallel to one another in a longitudinal direction as indicated by arrows 14 and 16. Conductors 10 and 12 also have regularly spaced complementary changes in their transverse dimensions along the longitudinal direction. For example, as shown in FIG. 1, these changes comprise a series of projections 18 on conductor 10 directed outwardly or away from conductor 12. At the same time, conductor 12 has projections 20 which are also directed outwardly or away from conducttor 10. The projections 18 and 20 are complementary, that is, their occurrences alternate on conductors 10 and 12 as can be seen in FIG. 1.

In the exemplary embodiment of FIG. 1, the projections 18 and 20 are rectangularly shaped and connected in series along the longitudinal direction by strips 24 and 26, respectively, disposed toward the inboard sides of the rectangularly-shaped projections so as to define a substantially constant separation gap 22 along a straight line separating the conductors 10 and 12. The radio frequency input and/or output to the array may be through a conventional transmission line such as, for example, a coaxial cable 28 having its inner conductor connected to one of the shaped antenna conductors (10 as shown in FIG. 1) and its outer shield conductor connected to the other shaped conductor (12 as shown in FIG. 1).

For ease of construction and to also conveniently maintain the desired orientation of the conductors 10 and 12, they are formed by selectively etching a copper or other conductive laminate adhered to one side of a dielectric sheet 30. The etching process employed is substantially the same as that used for forming printed circuit boards, microstrip antennas, and the like. Suitable dielectric and conductive materials and dimensions will be apparent to those in the art for particular antenna applications requiring a desired degree of flexibility for the array structure. Since the dielectric 30 forms no necessary electical function, it may be made as thin as mechanically feasible and of a material which best serves the mechanical function it is to perform so long as it continues to perform as a good electrical dielectric at the intended frequencies of antenna operation.

Figure 2:
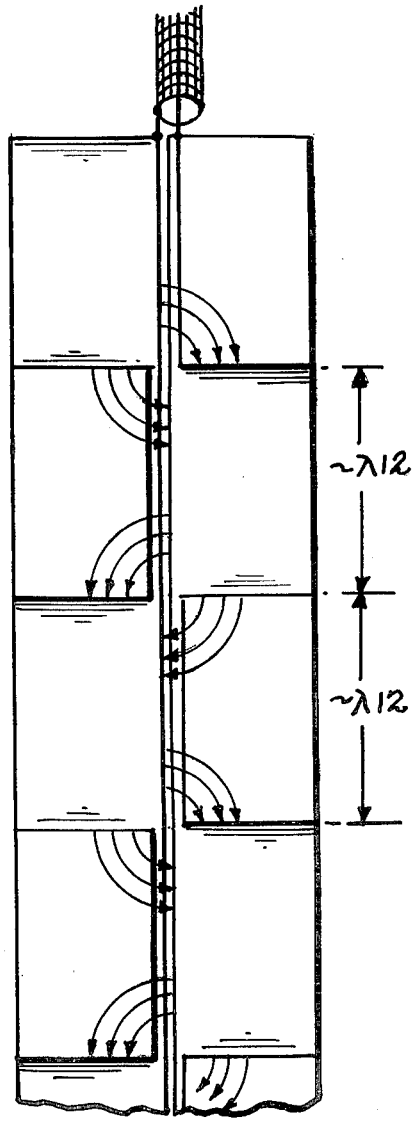
FIG. 2 is a cutaway plan view of the exemplary embodiment shown in FIG. 1 where the elements are dimensioned and spaced by one-half wavelength and where exemplary electric field patterns are depicted schematically to help explain the operation of the antenna.

When the radiating transitions are spaced substantially one-half wavelength apart as shown in FIG. 2, the electric fields in the vicinity of each transition are as schematically shown in FIG. 2. As is apparent from this sketch, the horizontal field components cancel in the far field, whereas vertical components add. Accordingly, the resulting array is polarized along its longitudinal length similar to the polarization expected from a collinear array of dipole radiators. The result is a directional pattern in every plane that includes the length of the array (i.e., the radiation pattern is directed away from the end of the array) which is yet omnidirectional in planes disposed orthogonal to the array length. Accordingly, if the array is suspended above the earth with its longitudinal axis directed toward the center of the earth, its radiation pattern will be properly directed to a desired portion of the earth's surface.

Figure 4:
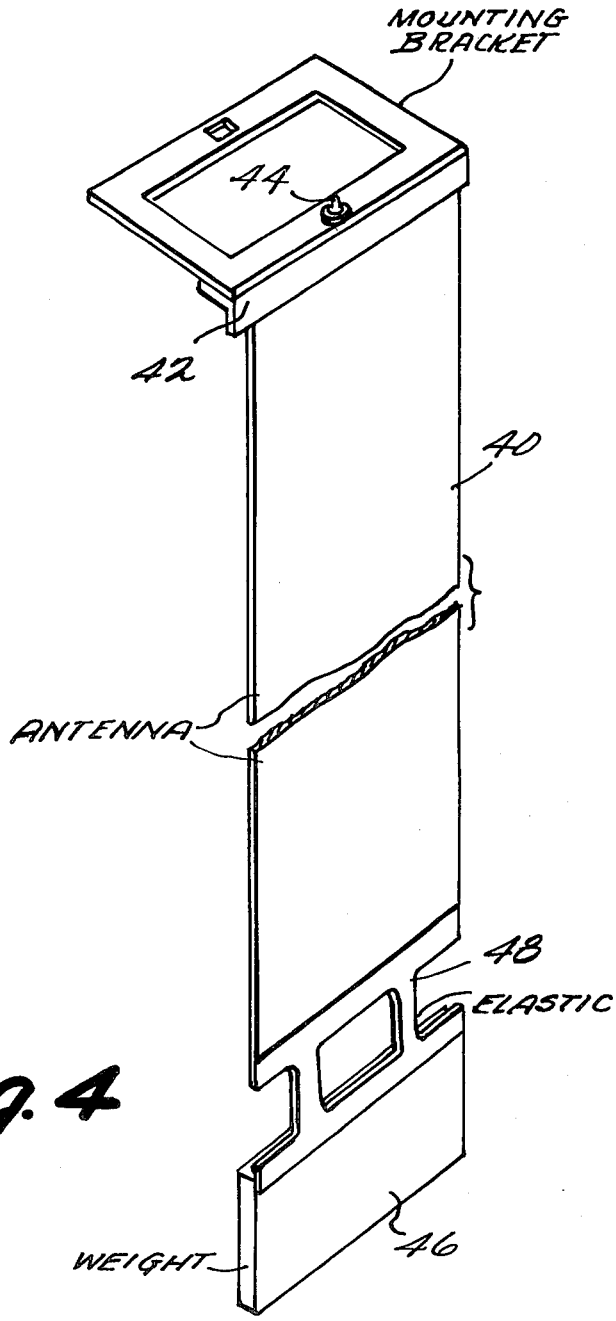
FIG. 4 is a perspective view of the antenna array deployed from a mounting bracket by a weight attached to the opposite end of the array.

A convenient technique for so directing the longitudinal axis of the antenna array is shown in FIG. 4. Here, the antenna array 40 is attached at one end to a mounting bracket 42 which also includes a coaxial cable connector 44 used in connecting the antenna to a coaxial transmission line, as will be appreciated. The other end of the array 40 is connected to a weight 46 which, through gravity forces, will maintain the longitudinal axis of the antenna directed to the earth's center. The weight 46 may be connected to the array 40 through an elastic or shock-absorbing member 48 as shown in FIG. 4. Furthermore, the entire array 40 and the connected weight 46 may be conveniently folded or rolled for storage purposes near the mounting bracket 42 prior to deployment. For a typical UHF application, the array 40 may have a length of several feet (i.e., 13–20 feet).

Because of the complementary variations in transverse dimension of the two spaced-apart conductors 10 and 12, better control is achieved over the radiation pattern provided by this antenna. For example, the fraction of total available power radiated from each transition is substantially determined by the width of each projection 18, 20. The relative phases of radiation which occur from each transitional location is substantially determined by their location along the array axis or, in other words, by the length of the projections 18, 20 and the interconnecting strips 24, 26. With control of these two variables, the radiation pattern can be shaped according to conventional antenna array design techniques substantially as desired.

Somewhat surprisingly, it has been discovered that even where the length of projections 18, 20 is reduced to approximately one-fourth wavelength, efficient radiation still results and produces an end-fire radiation pattern similar to that expected from a Yagi array.

Figure 3:
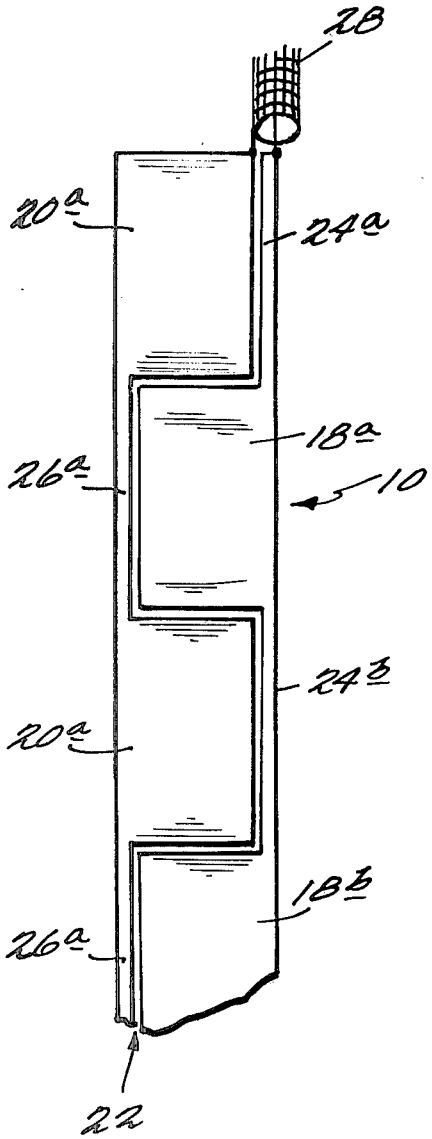
FIG. 3 is a cutaway plan view of another exemplary embodiment of this invention constituting a variation of the structure shown in FIG. 1.

A variation of the preferred exemplary embodiment shown in FIG. 1 is depicted in FIG. 3. Here, the projections 18 and 20 of conductors 10 and 12 are directed inwardly toward one another to define a separation gap 22 which extends along a non-straight path. In other words, the projections 18 and 20 are alternately extended toward the separation gap. Of course, the shaped conductors 10 and 12 in the embodiment of FIG. 3 would still preferably be formed by selectively etching the separation gap 22 along the serpentine-like path in a conductor laminated to one side of a very thin dielectric material. It is believed that the variation shown in FIG. 3 should operate very much the same as that shown in FIG. 1.

While only a few exemplary embodiments of this invention have been described in detail, those in the art will appreciate that such exemplary embodiments may be varied and/or modified in many different ways without departing from the novel and advantageous features of this invention. Accordingly, all such variations and modifications are intended to be included within the scope of the following claims.

What is claimed is:

1. A collinear series-fed array of radio frequency transmitting/receiving elements, said array comprising:

a first series of enlarged electrically conductive areas spaced apart and serially interconnected by relatively smaller electrical conductive strips, a second series of enlarged electrically conductive areas spaced apart and serially interconnected by relatively smaller electrically conductive strips, said first and second series being spaced apart but disposed symmetrically and in close proximity along their length and with the enlarged areas of the first series being disposed opposite the smaller strips of the second series whereby a collinear array of transmitting/receiving elements are defined by apertures between the two series, said first and second series being disposed, in operation, substantially apart and away from other electrically conductive surfaces whereby a substantially omnidirectional radiation pattern is achieved due to said symmetrical disposition defining said collinear array of transmitting/receiving elements, and one end of both said first and second series being adapted for electrical connection to send/receive radio frequency energy to/from said array of elements.

2. A collinear series-fed array as in claim 1 wherein said first and second series are disposed substantially within one common plane.

3. A collinear series-fed array as in claim 1 or 2 further comprising a layer of dielectric material and wherein said first and second series are disposed on said layer of dielectric material.

4. An omnidirectional collinear series-fed array as in claim 3 wherein each of said first and second series are integrally formed by selective removal of portions of a conductive layer adhered to said layer of dielectric material.

5. A collinear series-fed array as in claim 4 wherein said first and second series are disposed on the same side of said layer of dielectric material.

6. A collinear series-fed array as in claim 3 wherein said layer of dielectric material with said first and second series thereon is flexible and capable of being formed into a relatively compact unit for storage when not in use.

7. A collinear series-fed array as in claim 6 further comprising a mounting bracket attached to one end of said layer of dielectric and a weight attached to its opposite and for automatically extending and/or maintaining said array in an elongated operating position.

8. A collinear series-fed array as in claim 6 wherein each of said first and second series are integrally formed by selective removal of portions of a conductive layer adhered to said layer of dielectric material.

9. A collinear series-fed array as in claim 8 wherein said first and second series are disposed on the same side of said layer of dielectric material.

10. A collinear series-fed array as in claim 7 wherein each of said first and second series are integrally formed by selective removal of portions of a conductive layer adhered to said layer of dielectric material.

11. A collinear series-fed array as in claim 10 wherein said first and second series are disposed on the same side of said layer of dielectric material.

12. A collinear series-fed array as in claim 1 or 2 wherein said first and second series are disposed with their enlarged areas outwardly directed away from each other about a substantially straight line defined by the separation gap between said first and second series.

13. A collinear series-fed array as in claim 1 or 2 wherein said first and second series are disposed with their enlarged areas inwardly directed towards each other and with the enlarged areas of one series disposed in line with and between those of the other series to define a serpentine-like separation gap between said first and second series.

14. A series-fed array of radio frequency signal transmitting/receiving elements, said array comprising:

first and second electrically conductive surfaces extending along a longitudinal direction and having regularly spaced complementary changes in their transverse dimensions along said longitudinal direction, said complementary changes in transverse dimensions being oppositely directed at respectively corresponding locations along the longitudinal direction so as to define enlargements in said first conductive surface opposite narrowed portions in said second conductive surface and vice-versa, said first and second electrically conductive surfaces being spaced apart to define a separation gap having substantially constant dimensions, said first and second electrically conductive surfaces being adapted for disposition, in operation, substantially apart and away from other/electrically conductive surfaces, and input means including two electrical conductors respectively connected to corresponding ones of said first and second electrically conducting surfaces for supplying and/or receiving radio frequency electrical signals.

15. A series-fed array as in claim 14 wherein said separation gap is disposed along a substantially straight line and where said first and second surfaces are alternately extended outwardly away from said separation gap in their transverse dimensions at substantially equal intervals along said longitudinal direction.

16. A series-fed array as in claim 14 wherein said separation gap is disposed along a non-straight path and where said first and second surfaces are alternately extended toward said separation gap in their transverse dimensions at substantially equal intervals along said longitudinal direction.

17. A series-fed array as in claim 14, 15 or 16 further comprising a sheet of dielectric material, said first and second surfaces comprising at least one sheet of selectively removed electrically conducting material adhered to at least one surface of the dielectric material sheet.

18. A series-fed array as in claim 17 wherein said sheet of dielectric material with said first and second surfaces thereon is flexible and capable of being formed into a compact unit for storage when not in use.

19. A series-fed array as in claim 18 further comprising a mounting bracket attached to one end of said dielectric sheet and a weight attached to its opposite end for automatically extending and/or maintaining said array in an elongated operating position.

20. A series-fed array as in claim 14, 15 or 16 wherein each of said first and second electrically conductive surfaces comprise a series of rectangularly shaped sections serially connected together along said longitudinal direction by strips disposed toward a common side of the rectangularly shaped sections.

each of said rectangularly shaped sections having a length along said longitudinal direction substantially equal to one-half wavelength at the intended operating frequency of the array and a transverse width dimension corresponding to the relative desired amounts of radio frequency energy which is to be radiated or received from the array at that location along its longitudinal direction; and each of said strips having a length along said longitudinal direction substantially equal to one-half wavelength at the intended operating frequency of the array.

21. A series-fed radio frequency signal transmitting/receiving array comprising:

two spaced apart electrical conductors substantially isolated from electromagnetic interaction with other unconnected electrical conductors in the immediate vicinity thereof, said two spaced apart electrical conductors extending substantially parallel to one another in a longitudinal direction and having regularly spaced complementary changes in transverse dimensions along said longitudinal direction, said complementary changes in transverse dimensions being oppositely directed at respectively corresponding locations along the longitudinal direction so as to define enlarged areas in one of said conductors opposite narrowed areas in the other of said conductors and vice-versa, and means for connecting one end of each of said two-spaced apart electrical conductors to a radio frequency signal transmitter or receiver.

22. A series-fed array as in claim 21 wherein said transverse changes in dimensions of one conductor define a series of projections extending away from the other conductor.

23. A series-fed array as in claim 21 wherein said transverse changes in dimensions of one conductor define a series of projections extending towards the other conductor.

24. A series-fed array as in claim 21, 22 or 23 further comprising a sheet of dielectric material adhered to said two spaced apart conductors.

25. A series-fed array as in claim 24 wherein said sheet of dielectric with said two spaced apart conductors thereon is flexible and capable of being formed into a compact unit for storage when not in use.

26. A series-fed array as in claim 25 further comprising a mounting bracket attached to one end of said dielectric sheet and a weight attached to its opposite end for automatically extending and/or maintaining said array in an elongated operating position.

27. A series-fed array as in claim 21, 22 or 23 wherein each of said two spaced apart conductors comprise a series of rectangularly shaped sections serially connected together along said longitudinal direction by strips disposed toward a common side of the rectangularly shaped sections, each of said rectangularly shaped sections having a length along said longitudinal direction substantially equal to one-half wavelength at the intended operating frequency of the array and a transverse width dimension corresponding to the relative desired amounts of radio frequency energy which is to be radiated or received from the array at that location along its longitudinal direction; and each of said strips having a length along said longitudinal direction substantially equal to one-half wavelength at the intended operating frequency of the array.

* * * * *